US006345924B1

(12) United States Patent
Whaley

(10) Patent No.: US 6,345,924 B1
(45) Date of Patent: Feb. 12, 2002

(54) NESTABLE BINDER RING ASSEMBLY

(75) Inventor: Paul Whaley, Herculaneum, MO (US)

(73) Assignee: U.S. Ring Binder Corp., St. Louis, MO (US)

( * ) Notice: Subject to any disclaimer, the term of this patent is extended or adjusted under 35 U.S.C. 154(b) by 0 days.

(21) Appl. No.: 09/524,186

(22) Filed: Mar. 13, 2000

(51) Int. Cl.[7] ..... B42F 13/20

(52) U.S. Cl. ..... 402/26; 402/70; 402/71; 402/78; 402/501; 402/502; 402/39

(58) Field of Search ..... 402/26, 70, 71, 402/78, 501, 502, 80 V, 80 K, 39

(56) References Cited

U.S. PATENT DOCUMENTS 4,368,995 A * 1/1983 Cohen ..... 402/39
5,642,954 A * 7/1997 Hudspith ..... 403/36
D405,113 S * 2/1999 Ko ..... D19/27
D409,240 S * 5/1999 Ko ..... D19/32
5,964,544 A * 10/1999 Ko ..... 402/36

* cited by examiner

*Primary Examiner*—A. L. Wellington
*Assistant Examiner*—Alisa L. Thurston
(74) *Attorney, Agent, or Firm*—Polster, Lieder, Woodruff & Lucchesi, LC

(57) ABSTRACT

A binder ring assembly (10) for a ring binder comprises a plurality of spaced binder rings (12–16). A user operable mechanism (18) to which the rings are attached allows the user to open and close the rings to open and close the binder. A shield (22) covers the mechanism. The binder rings protrude through the shield. A recess (26) is formed in the cover adjacent each cover location where a binder ring is located. During shipment of binder ring assemblies, one layer (L1) of assemblies is placed in a container (C) with another, inverted layer (L2) of assemblies placed over them. The outer ends of the binder rings are received in the recesses of the covers, and the depth of each recess is such that the outer end of the binder rings of the mating assembly will not come out of the recesses and rub against the non-recessed portion of the cover which, if scratched, renders the assembly unusable.

14 Claims, 3 Drawing Sheets

NESTABLE BINDER RING ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to ring binders, and more particularly, to a binder ring assembly which is both decorative and functional. The functionality of the binder ring assembly is that its construction facilitates packaging and shipping of the binder ring assemblies from where they are manufactured to where they are used in making a ring binder so to substantially lower their cost.

Typically, binder ring assemblies are manufactured in one location, and shipped from there to an assembler who uses the assemblies in fabricating ring binders. Heretofore, binder ring assemblies have been shipped in cartons in which rows of binder ring assemblies are laid out. A first row of binder ring assemblies are placed on the bottom of the carton in a side-by-side arrangement. The next row of assemblies is then fitted in place above the first row. To save space, the assemblies forming the second row are inverted as they are set in place so the two adjacent rows are in an interfitting or mating arrangement.

One problem with this configuration is that the outer end of the binder rings contact and can rub against the outer surface of the shield of the assembly immediately below (or above it) and the surface can be scratched. The outer surface of the shield usually has a high polish; for example, it has a mirrored finish. The rubbing which can occur during shipping will scratch this surface and the resulting blemish is readily apparent. Accordingly, binder ring assemblies with scratched shield surfaces are rejected for reasons of appearance.

To prevent this, it is current practice to insert strips of cardboard between the adjacent, mating layers of assemblies as they are installed in a shipping container. The height of the cardboard is slightly greater than the height the binder rings extend above their shields so to keep the binder rings of assemblies in one row from contacting and scratching the shield of the assemblies in the mating row. While this prevents scratching, the height of the cardboard strips means there is less space in a container to stack binder ring assemblies. This, in turn, means more containers may be required to ship a quantity of containers adding to the cost of a ring binder.

BRIEF SUMMARY OF THE INVENTION

Among the several objects of the present invention may be noted the provision of a binder ring assembly which is nestable with similar assemblies;

- the provision of such binder ring assemblies which are stackable in shipping containers in layers with assemblies comprising a first layer being arranged with their binder rings extending up and the assemblies comprising the layer immediately above being inverted so their binder rings extend down and the two layers nest with each other;
- the provision of such binder ring assemblies in which a portion of the cover or shield of each assembly has a depressed section formed adjacent each binder ring so when the layers of assemblies are placed in the container, the distal end of the respective binder rings only bear against the recessed portion of the cover and not against any other portion thereof. This prevents rubbing and scratching of the binder rings against the raised, highly finished or polished surfaces of the assemblies during shipment;
- the provision of such an assembly in which the recessed portions of its shield do not readily show any scratch which may occur so the assembly has substantially less chance of being rejected than conventional assemblies;
- the provision of such an assembly in which the recessed portion is crosshatched or otherwise decoratively finished so as to not to show any scratching which might occur;
- the provision of such assemblies to be loaded into shipping containers without the need of separators so more layers of assemblies can be fitted into a same size container and thereby reduce shipping costs; and,
- the provision of such an assembly which is generally the same in cost as conventional assemblies but which produces a substantial saving due to the reduced rejection rate of binder assemblies for use in binders and reduced shipping costs.

In accordance with the invention, generally stated, a binder ring assembly for a ring binder includes a plurality of spaced binder rings and a user operable mechanism for opening and closing the rings. A shield fits over and covers the mechanism. The shield has openings therein through which binder ring segments protrude with the outer, distal end of the segments interfitting with each other when the binder is closed. During shipment of binder ring assemblies, one layer of assemblies is placed in a container and another layer of inverted assemblies are placed over them so the two layers nest together. Adjacent each location on each cover where the binder rings are located, a recess is formed in the cover. This recess extends to either side of the binder ring location and when the layers are formed, the binder rings are received in these recesses. The depth of each recess is such that the distal end of the binder ring of the mating assembly will not slide out of the recess and rub against the non-recessed portion of the cover which, if scratched or blemished renders the assembly unsuitable for use. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
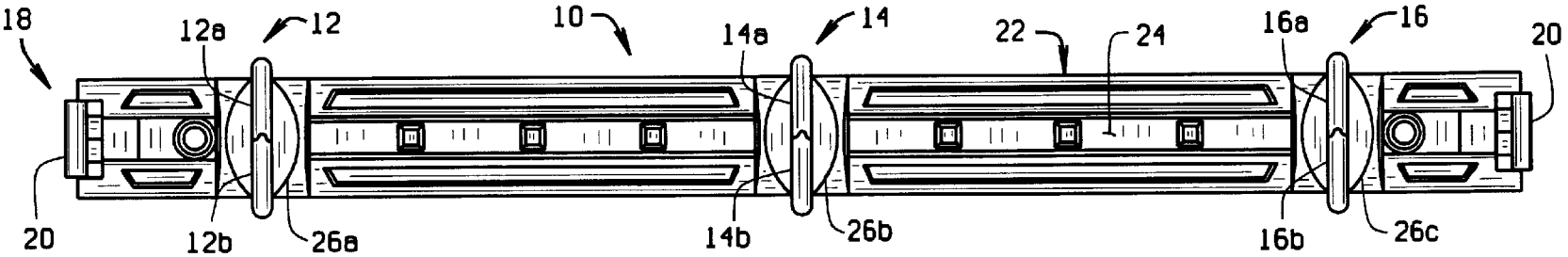
FIG. 1 is a top plan view of one embodiment of a nestable binder ring assembly of the present invention.
Figure 3:
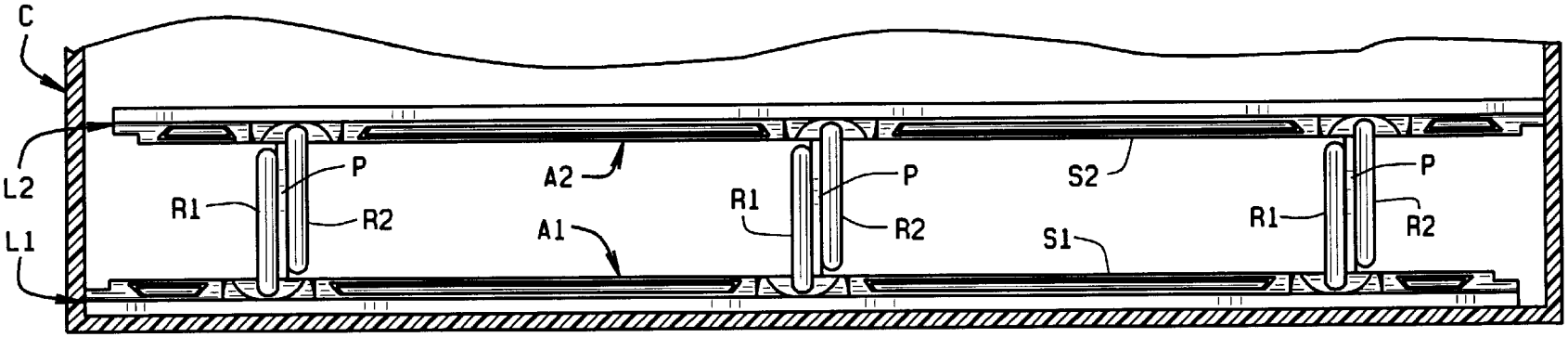
FIG. 3 PRIOR ART
FIG. 3 is a simplified representation of a prior art stacked configuration of assemblies using separator strips to prevent damage to an assembly during shipping; and, FIG. 4 is an end view of the prior art stacked configuration.
Figure 4:
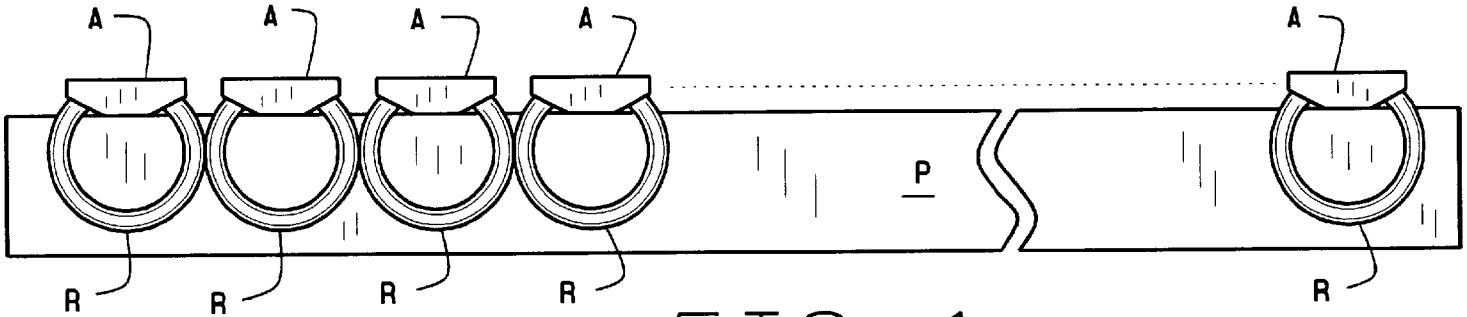
FIG. 4 PRIOR ART

Referring to the FIG. 3, a prior art configuration of binder ring assemblies A1 and A2 is shown. Each assembly is identical and is shown to include three binder rings R1 and R2. As is well-known in the art, the binder rings are operable by a leaf mechanism (not shown) to which ends of ring segments forming the binder rings are attached. This mechanism is covered by a shield S1, S2. The shield is typically a curved metal plate the outer surface of which is highly polished. When installed in a container C for shipment, the assemblies are arranged in layers L1, L2, etc. The assemblies comprising layer L1 are placed upright in the container while those assemblies comprising layer L2 are inverted. This alternating arrangement of layers makes it possible to ship more assemblies in a container than if all the assemblies were oriented in one direction or the other. Heretofore with the arrangement depicted in FIG. 3, if the outer portion of the rings of one assembly were to rub against the finished outer surface of the shield of the assembly against which they abutted, the surface could be scratched which would render the assembly unusable. To prevent this, elongate strips P are inserted after each upright layer was set in place and before the associated inverted layer is placed in the container. The height of the strips is slightly greater than height the rings extended above the cover, thus preventing contact between the two. However, as previously mentioned, the additional height imposed by use of the strip reduces the number of layers which can be arranged in a container. In accordance with the present invention, and as shown in FIG. 1, A binder ring assembly 10 for a ring binder (not shown) includes a plurality of spaced binder rings. Three such binder rings 12, 14, and 16 are shown in FIG. 1; although it will be understood that an assembly may include more, or fewer, such rings. Each ring is comprised of two mating ring segments 12*a*, 12*b*, 14*a*, 14*b*, and 16*a*, 16*b*. One end of each ring segment is attached to a leaf (not shown). The leaves are part of a user operable mechanism indicated generally 18 to which the rings are attached for opening and closing the rings to open and close the binder. Mechanism 18 further includes levers 20 located at each end of the assembly and by which a user can open and close the rings.

Figure 2:
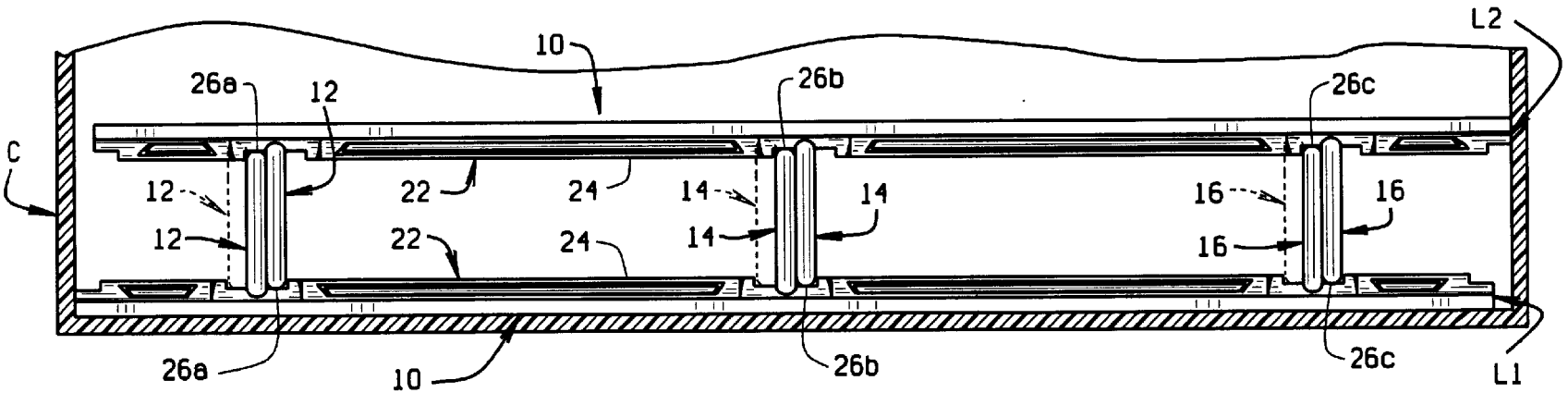
FIG. 2 is a side elevational view of two assemblies arranged in a stacked configuration.

An elongate shield 22 which is made of a metal or plastic covers the mechanism. The shield has openings formed in it by which the rings protrude through the cover. An outer surface 24 of the shield can be plain, or as shown in FIG. 1, formed so as to have a decorative appearance. Unlike prior shield constructions, the shield of the present invention has a recess 26 formed in it adjacent each location where a binder ring is located. Accordingly, shield 22 has three recesses 26*a*–26*c*, a recess being formed at each ring location. Each recess is deep enough so that when the assemblies are stacked in container C (see FIG. 2), they nest together and the outer, distal end of the rings each fit in a pocket formed by the recess. This accomplishes a number of things.

First, when the assemblies 10 are now layered in a shipping container C, the outer end of the rings are below the portion of the shield surface 24 which is highly finished. As such, the ends of the rings cannot and do not rub against the non-recessed portion of the shield. The surface is now not susceptible to the scratching which would make it unsuitable for use in a binder. Second, there is now no need for the separator strips. Elimination of the strips saves packaging costs. In addition, the overall height of the interfitting layers of assemblies is lessened meaning that more layers can be fitted into each container. This reduces the number of containers required to ship a quantity of assemblies further decreasing shipping costs.

The recesses 26 formed in a shield are generally symmetrical about the binder rings. That is, the pockets formed by the recesses extend equidistantly on either side of the binder ring. As shown by the dashed lines in FIG. 2, this means that the binder rings of an interfitting or nesting assembly 10 can be on either side of the binder rings of the assembly in the other layer so that it is immaterial how the assemblies in the second layer are stacked relative to those in the first layer.

Figure 5:
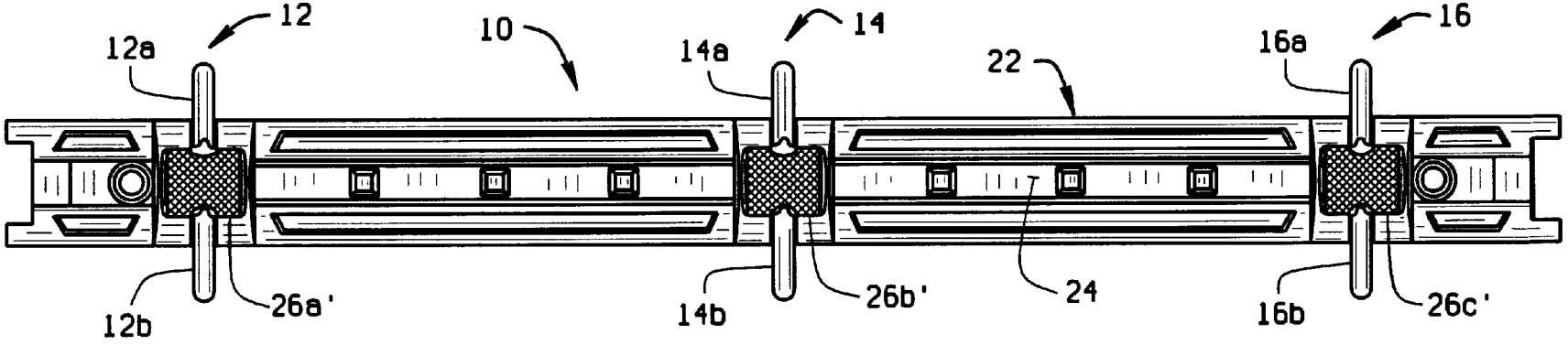
FIG. 5 is a top plan view of a second embodiment of a nestable binder ring assembly of the invention.

In FIG. 1, the recesses 26 are shown to have a plain outer surface. However, these surfaces can also be decoratively formed. As shown in FIG. 5, the recesses 26*a*', 26*b*', and 26*c*' are formed in a cross-hatch pattern. Other patterns can also be created so that the recesses are not only functional, but also have an aesthetic appearance as well. Those skilled in the art will appreciate that other designs can be implemented in the recesses without departing from the scope of the invention. It will further be understood that the shape of the recess can also differ without departing from the scope of the invention. Thus as shown in FIG. 1, the recess can have an ovate or elliptical shape when viewed in plan. The longer axis can either be orthogonal to the longitudinal axis of the shield as shown in FIG. 1, or it may be parallel to it. Or, as shown in FIG. 5, the recess can have a rectangular or square shape when so viewed. The floor of the recess may be flat, or it may be scooped. Finally, although not shown in the drawings, it will be understood that both the shape and ornamental pattern of each recess can be different. For example, for a three ring binder assembly such as shown in the drawings, the two end recesses may have the appearance of the recesses shown in the assembly of FIG. 1, while the middle recess may the appearance of those shown in the assembly of FIG. 5.

What has been described is a binder ring assembly in which the shield has a cover with recesses formed in it at each binder ring location. The recesses facilitate shipping of assemblies less expensively than has previously been possible and, at the same time, preventing scratching or other damage to an assembly during transit.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A binder ring assembly for a ring binder comprising:

at least one binder ring; and, an elongate shield from which the binder ring protrudes, a recess being formed in the shield at the location on the shield where the binder ring is located, the recess extending on both sides of the binder ring location so that during shipment of binder ring assemblies in which one layer of assemblies is placed in a container and another layer of assemblies is inverted and placed over the first said layer with the binder ring on one assembly substantially abutting against the binder ring on the other assembly to one side of the binder ring or the other, the binder ring on each assembly is received in the recess in the shield on the other assembly with the depth of each recess being such that the distal ends of the binder rings of the interfitting assemblies fit in the recess and do not rub against the non-recessed portion of the respective shields which, if scratched or blemished renders the assembly unusable.

2. The binder ring assembly of claim 1 wherein each assembly includes a plurality of spaced binder rings each of which protrudes through the shield of the assembly and a recess is formed at each location on the shield where a binder ring is located, each recess extending on both sides of the binder ring location.

3. The binder ring assembly of claim 2 wherein each recess extends equidistantly on both sides of a binder ring location thereby to facilitate interfitting of assemblies when they are placed in a shipping container.

4. The binder ring assembly of claim 1 wherein the recess is ovate shaped when viewed in plan.

5. The binder ring assembly of claim 1 wherein the recess is rectangular shaped when viewed in plan.

6. The binder ring assembly of claim 2 wherein each recess is ovate shaped when viewed in plan.

7. The binder ring assembly of claim 2 wherein each recess is rectangular shaped when viewed in plan.

8. The binder ring assembly of claim 2 wherein at least one of the recesses is ovate shaped when viewed in plan and at least one of the other recesses is rectangular shaped when viewed in plan.

9. A binder ring assembly for a ring binder comprising:

a plurality of binder rings spaced apart from each other;

a user operable mechanism to which the rings are attached for opening and closing the rings to open and close the binder; and, a shield covering the mechanism and through which the binder rings protrude, a recess being formed in the shield at each location on the shield where a binder ring is located with each recess extending on both sides of the binder ring location so that during shipment of binder ring assemblies in which one layer of assemblies is placed in a container and another layer of assemblies is inverted and placed over the first said layer with respective binder rings on one assembly substantially abutting against the binder rings on the other assembly to one side of the corresponding binder ring or the other, the binder rings on each assembly are received in a corresponding recess in the shield on the other assembly with the depth of each recess being such that a distal end of the binder ring of the interfitting assemblies fits in the recess and does not rub against the non-recessed portion of the shield which, if scratched or blemished, renders the assembly unusable.

10. The binder ring assembly of claim 9 wherein each recess extends equidistantly on both sides of a binder ring location thereby to facilitate interfitting of assemblies when they are placed in a shipping container.

11. The binder ring assembly of claim 10 wherein each recess is ovate shaped when viewed in plan.

12. The binder ring assembly of claim 10 wherein each recess is rectangular shape when viewed in plan.

13. A method of shipping binder ring assemblies comprising:

placing a first layer of assemblies in a shipping container, each assembly including a plurality of spaced binder rings and an elongate shield from which the binder rings protrude;

placing a second layer of similarly formed assemblies in the container over the first layer thereof, the assemblies comprising the second layer being inverted so the assemblies in the respective layers interfit with the binder rings protruding from the shields of the respective assemblies in the two layers extending toward the shield of the assembly in the other layer with respective binder rings on the one assembly substantially abutting against the binder rings on the other assembly to one side of the corresponding binder ring or the other; and, forming a recess in the shield of each assembly shield at the location on the shield where each binder ring is located with each recess extending on both sides of the binder ring location, so that the binder rings on each assembly are received in a corresponding recess in the shield on the other assembly with the depth of each recess being such that a distal end of the binder ring of the interfitting assemblies does not rub against the non-recessed portion of the shield which, if scratched or blemished, renders the assembly unusable.

14. The method of claim 13 wherein each recess extends equidistantly on both sides of a binder ring location thereby to facilitate interfitting of the assemblies when they are placed in the container.

* * * * *